US011926801B2

(12) United States Patent
Choi et al.

(10) Patent No.: US 11,926,801 B2
(45) Date of Patent: Mar. 12, 2024

(54) PROCESSES AND SYSTEMS FOR PRODUCING UPGRADED PRODUCT FROM RESIDUE

(71) Applicant: Saudi Arabian Oil Company, Dhahran (SA)

(72) Inventors: Ki-Hyouk Choi, Dhahran (SA); Mohammed S. Aldossary, Dhahran (SA); Abdullah T. Alabdulhadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 275 days.

(21) Appl. No.: 17/160,699

(22) Filed: Jan. 28, 2021

(65) Prior Publication Data

US 2022/0235283 A1 Jul. 28, 2022

(51) Int. Cl.

| | |
|---|---|
| ***C10G 67/00*** | (2006.01) |
| ***C10G 49/18*** | (2006.01) |
| ***C10G 67/04*** | (2006.01) |

(52) U.S. Cl.

CPC ..... *C10G 67/0463* (2013.01); *C10G 49/18* (2013.01); *C10G 2300/107* (2013.01);

(Continued)

(58) Field of Classification Search

CPC .... C10G 31/08; C10G 67/0454; C10G 49/18; C10G 67/049; C10G 67/0463; C10G 21/003; C10G 2400/06; C10G 2300/4081; C10G 2300/206; C10G 2300/107; C10G 2400/02; C10G 2300/1077;

(Continued)

(56) References Cited

U.S. PATENT DOCUMENTS 4,290,880 A * 9/1981 Leonard ..... B01D 11/0407 208/309

6,332,975 B1 12/2001 Abdel-Halim et al.

(Continued)

FOREIGN PATENT DOCUMENTS

WO 2013019687 A1 2/2013

OTHER PUBLICATIONS

Sattarin et al., "Solvent Deasphalting of Vacuum Residue in a Bench-Scale Unit", Petroleum & Coal, vol. 48, No. 3, pp. 14-19, 2006.

(Continued)

*Primary Examiner* — Prem C Singh
*Assistant Examiner* — Brandi M Doyle
(74) *Attorney, Agent, or Firm* — Dinsmore & Shohl LLP

(57) ABSTRACT

Embodiments of the present disclosure are directed to a process for producing upgraded product from residue comprising atmospheric residue or vacuum residue upgrading comprising separating the residue through a Solvent Deasphalting (SDA) unit, wherein the SDA unit includes an asphaltene separator that separates the residue into asphaltene pitch and a stream comprising deasphalted oil (DAO) and resin, and a resin separator that subsequently separates the stream comprising DAO and resin into separate DAO and resin streams, treating the resin stream with supercritical water (SCW) to produce an upgraded resin stream, and hydroprocessing a portion of the upgraded resin stream and the DAO stream to produce the upgraded product.

17 Claims, 2 Drawing Sheets

(52) U.S. Cl.
CPC ..... *C10G 2300/1074* (2013.01); *C10G 2300/202* (2013.01); *C10G 2300/206* (2013.01); *C10G 2300/308* (2013.01); *C10G 2300/4081* (2013.01); *C10G 2400/06* (2013.01)

(58) Field of Classification Search
CPC ..... C10G 2300/202; C10G 2300/1074; C10G 2300/308
See application file for complete search history.

(56) References Cited

U.S. PATENT DOCUMENTS

| | | | | |
|---|---|---|---|---|
| 7,214,308 | B2 | 5/2007 | Colyar | |
| 8,048,291 | B2 | 11/2011 | Subramanian et al. | |
| 9,296,959 | B2 | 3/2016 | Gillis | |
| 10,066,176 | B2 | 9/2018 | Choi et al. | |
| 10,344,228 | B2 | 7/2019 | Choi et al. | |
| 10,577,546 | B2 | 3/2020 | Choi et al. | |
| 2004/0163996 | A1* | 8/2004 | Colyar | C10G 65/18 208/108 |
| 2017/0166819 | A1 | 6/2017 | Choi et al. | |
| 2018/0187093 | A1* | 7/2018 | Choi | C10G 31/08 |
| 2019/0249096 | A1 | 8/2019 | Choi et al. | |

OTHER PUBLICATIONS

Notification of Transmittal of the International Search Report and the Written Opinion of the International Searching Authority, or the Declaration dated Apr. 12, 2022 pertaining to International application No. PCT/US2022/013999 filed Jan. 27, 2022, 18 pages.

Al-Muntaser, Ameen A. et al. "Hydrothermal upgrading of heavy oil in the presence of water at sub-critical, near-critical and supercritical conditions", Journal of Petroleum Science and Engineering, Oct. 14, 2019, pp. 1-12, vol. 184, Elsevier, Amsterdam, NL.

* cited by examiner

PROCESSES AND SYSTEMS FOR PRODUCING UPGRADED PRODUCT FROM RESIDUE

TECHNICAL FIELD

Embodiments of the present disclosure generally relate to processes and systems for producing upgraded product from residue.

BACKGROUND

Generally, a solvent deasphalting (SDA) process is employed by an oil refinery for the purpose of extracting valuable components from a residual oil. In conventional SDA processes, a residue oil is separated into deasphalted oil (DAO) and asphaltene pitch, by using hydrocarbon solvents. Common solvents are light paraffinic solvents (carbon number ranging from 3 to 5). The high polarity and high molecular weight of asphaltene result in poor solubility in the paraffinic solvents. Thus, the solvents employed in the SDA process are able to precipitate asphaltene pitch and the SDA process separates the DAO from the residue oil. While the residue oil is not able to be processed by the catalytic hydroprocessing due to its high content of metals and inertness of large molecules, the DAO separated from the residue oil has acceptable qualities, such as low content of metals, for catalytic hydroprocessing. Thus, the SDA process has been utilized in industry for a long time as one of major upgrading processes for residue oil.

However, the SDA process rejects a substantial portion of residue oil into the asphaltene pitch. For maintaining certain quality of DAO for subsequent hydroprocessing, the liquid yield of DAO conventionally must be less than or equal to 80 wt. %. Conversely, hydroprocessing DAO having more than 80% liquid yield must be conducted at severe conditions, such as temperature greater than 400° C., and hydrogen pressure greater than 20 MPa, to obtain marketable fuel and chemical feedstock. In most cases, refineries are optimizing liquid yield of DAO for maximizing production of final products while minimizing operating costs of hydroprocessing. Thus, in most conventional SDA processes, the DAO yield is limited by the following hydroprocessing unit.

That said, alternative SDA processes separates the residue oil into DAO, resin, which is regarded as an end fraction of DAO, and asphaltene pitch streams. Although the resin has higher impurity contents and higher boiling point range than DAO, it is able to be processed by hydroprocessing. However, the resin alone is not able to be processed by hydroprocessing without employing severe conditions.

SUMMARY

Accordingly, there is an ongoing need for improved systems and processes for upgrading residue using mild hydroprocessing conditions, while minimizing production of low valued asphaltene pitch. Embodiments of the present disclosure meet this need by separating the resin stream from the residue oil and treating the resin stream with supercritical water (SCW) before hydroprocessing. The SCW treated resin may then be hydroprocessed under mild hydroprocessing conditions to increase the yield of marketable upgraded products, while minimizing production of asphaltene pitch.

According to one or more aspects of the present disclosure, a process for producing upgraded product from residue comprising atmospheric residue or vacuum residue upgrading may comprise separating the residue through the SDA unit, wherein the SDA unit includes an asphaltene separator that separates the residue into asphaltene pitch and a stream comprising DAO and resin, and a resin separator that subsequently separates the stream comprising DAO and resin into separate DAO and resin streams, treating the resin stream with SCW to produce an upgraded resin stream, and hydroprocessing a portion of the upgraded resin stream and the DAO stream to produce the upgraded product.

According to one or more other aspects of the present disclosure, a system for producing upgraded product from residue comprising atmospheric residue or vacuum residue upgrading may comprise a SDA unit operable to separate the residue, wherein the SDA unit includes the asphaltene separator that separates the residue into asphaltene pitch and the stream comprising DAO and resin, and the resin separator that subsequently separates the stream comprising DAO and resin into separate DAO and resin streams; the SCW unit downstream of the SDA unit, the SCW unit operable to treat the resin stream with supercritical water to produce an upgraded resin stream; and the hydroprocessing unit downstream of the SCW unit, the hydroprocessing unit operable to hydroprocess a portion of the upgraded resin stream and the DAO stream to produce the upgraded product.

Additional features and advantages of the described embodiments will be set forth in the detailed description which follows, and in part will be readily apparent to those skilled in the art from that description or recognized by practicing the described embodiments, including the detailed description which follows as well as the drawings and the claims.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
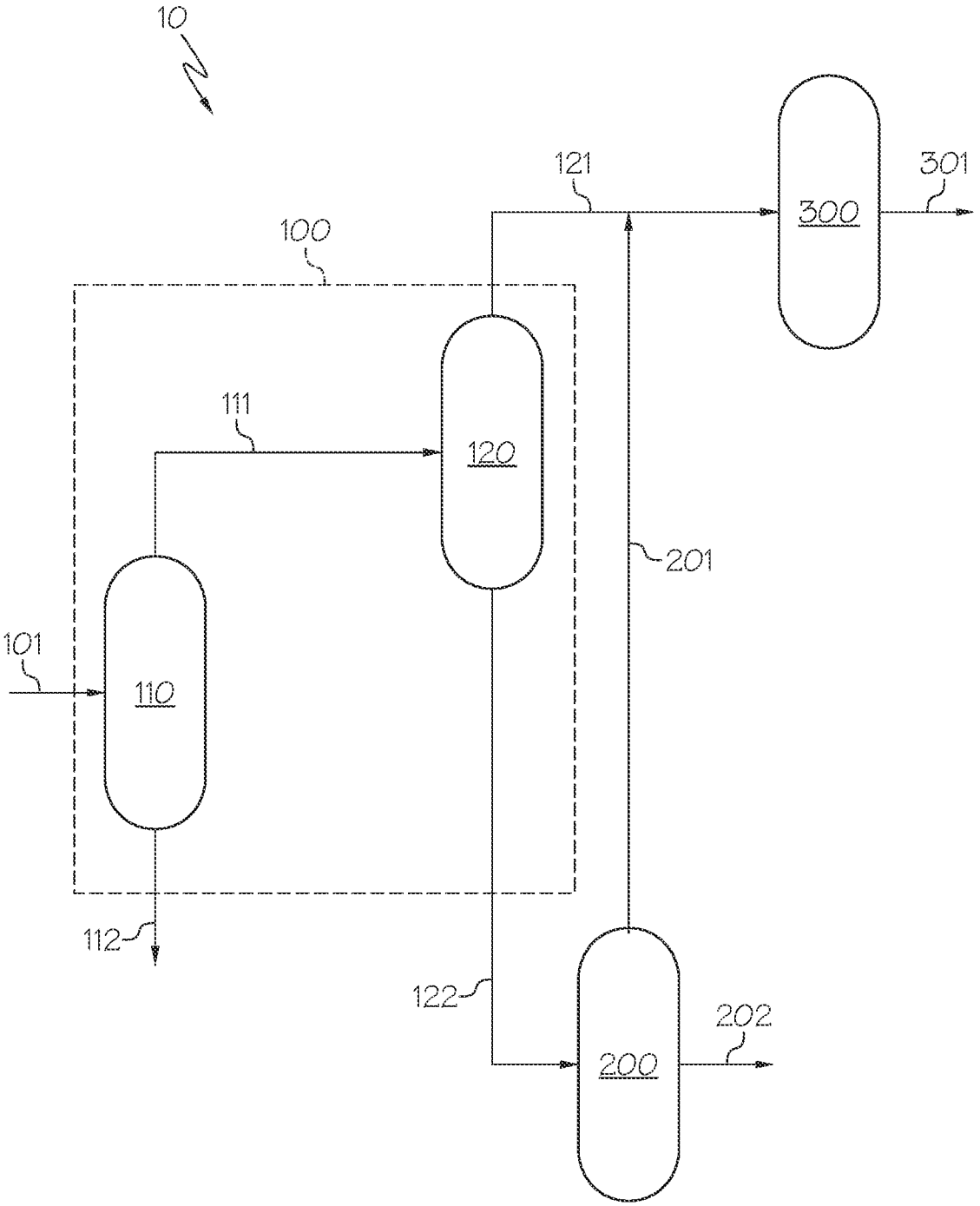
FIG. 1 is a schematic illustration of a system and process for producing upgraded product from residue upgrading in accordance with one or more embodiments of the present disclosure.
Figure 2:
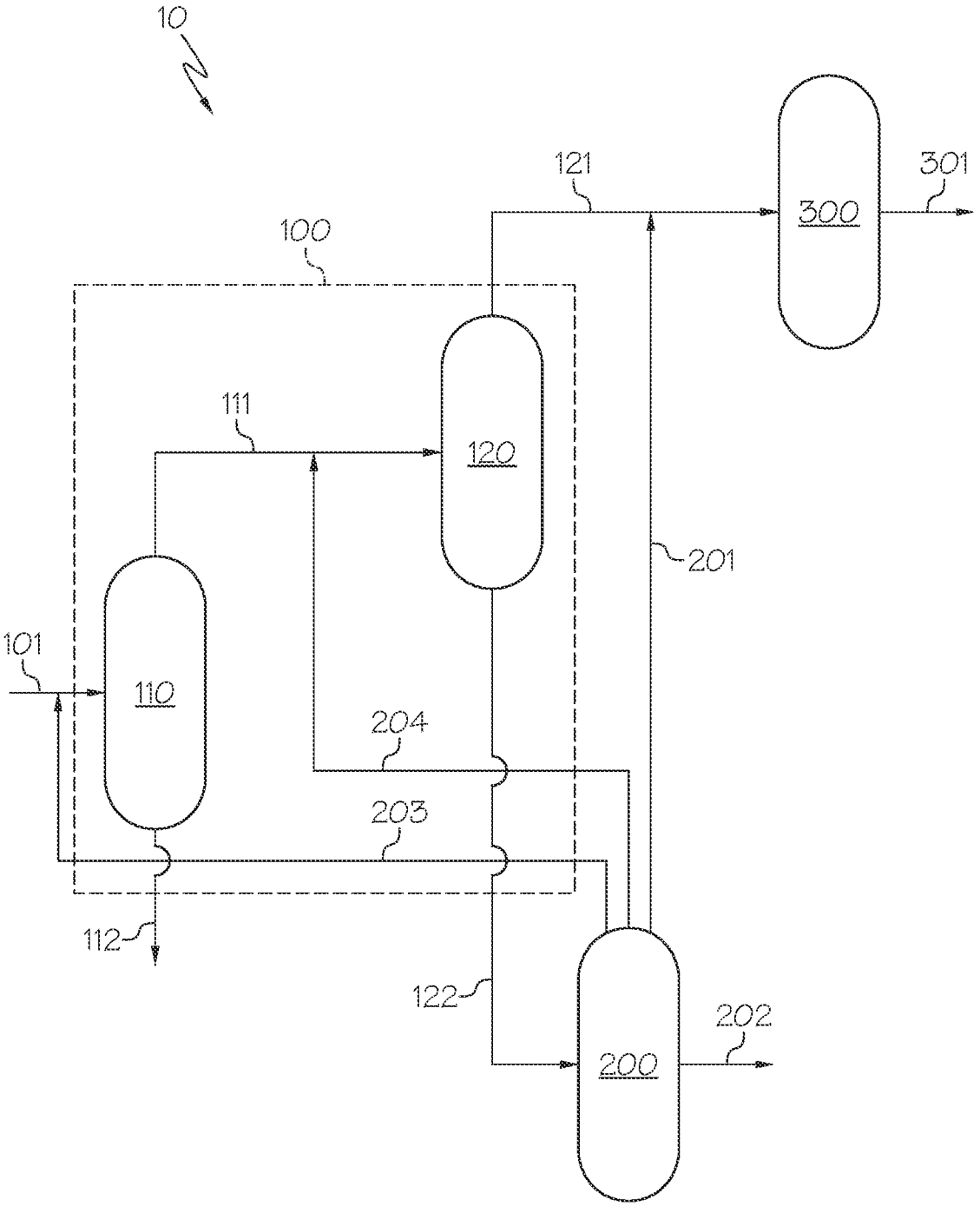
FIG. 2 is a schematic illustration of another system and process for producing upgraded product from residue upgrading in accordance with one or more embodiments of the present disclosure.

For the purpose of describing the simplified schematic illustrations and descriptions of FIGS. 1-2, the numerous valves, temperature sensors, pressure sensors, electronic controllers, pumps, and the like that may be employed and well known to those of ordinary skill in the art of certain chemical processing operations are not included. Further, accompanying components that are often included in chemical processing operations, such as, for example, air supplies, heat exchangers, surge tanks, compressors, or other related systems are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines, which may serve to transfer process steams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows, which do not connect two or more system components, signify a product stream, which exits the depicted system, or a system inlet stream, which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1-2. Mixing or combining may also include mixing by directly introducing both streams into the same reactor, separation device, or other system component. For example, it should be understood that when two streams are depicted as being combined directly prior to entering a separation unit or reactor, that in some embodiments the streams could equivalently be introduced into the separation unit or reactor individually and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Definitions

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the volume of each catalyst bed.

As used in this disclosure, a "separator" refers to any separation device or system of separation devices that at least partially separates one or more chemicals that are mixed in a process stream from one another. For example, a separator may selectively separate differing chemical species, phases, or sized material from one another, forming one or more chemical fractions. Examples of separators include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separator and be divided, or separated, into two or more process streams of desired composition.

As used in this disclosure, "asphaltene" refers to a hydrocarbon composition consisting primarily of carbon, hydrocarbon, nitrogen, oxygen and sulfur, with trace amounts of vanadium, nickel, iron, and other metals. Without being bound by theory, asphaltene refers to the portion of petroleum that is not dissolved in paraffin solvent (the dissolved portion is referred to as maltene).

As used in this disclosure, "supercritical water" or "SCW" refers to water at a pressure and a temperature greater than that of its critical pressure and temperature, such that distinct phases do not exist and the substance may exhibit the diffusion of a gas while dissolving materials like a liquid. At a temperature and pressure greater than the critical temperature and pressure of water, the liquid and gas phase boundary disappears, and the fluid has characteristics of both fluid and gaseous substances. SCW is able to dissolve organic compounds like an organic solvent and has excellent diffusibility like a gas. Regulation of the temperature and pressure allows for continuous "tuning" of the properties of the SCW to be more liquid or more gas like. SCW has reduced density and lesser polarity, as compared to liquid-phase sub-critical water, thereby greatly extending the possible range of chemistry, which can be carried out in water.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetallization, desulfurization, and denitrogenation.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "DAO stream" passing from a first system component to a second system component should be understood to equivalently disclose "DAO" passing from a first system component to a second system component, and the like.

Systems for Upgrading of the Residue to Produce Upgraded Product

Embodiments of the present disclosure are directed to systems for upgrading of the residue, such as atmospheric residue, vacuum residue, or both, to produce upgraded product, such as naphtha, gas oil, vacuum gas oil, or combinations thereof. Referring to FIGS. 1 and 2, systems 10 for upgrading residue 101 is schematically depicted. The system 10 may be utilized in a process for producing upgraded product 301 from the residue 101 upgrading.

The residue 101 may be introduced to the system 10. Various compositions are contemplated for the residue 101. In one or more embodiments, the residue 101 may include atmospheric residue, vacuum residue, or both.

In some embodiments, the residue 101 may have an American Petroleum Institute (API) Gravity value of less than or equal to 25, or less than or equal to 22. The residue 101 may have an API gravity from 1 to 25, from 1 to 22, from 10 to 25, from 5 to 25, from 8 to 22, or 16.

In some embodiments, the residue 101 may have a true boiling point (TBP) in which 10% of the fraction evaporates at temperatures of greater than or equal to 600 Fahrenheit (° F.), greater than or equal to 650° F. or greater than or equal to 900° F. A TBP may be measured by ASTM D2892 or ASTM D5236.

The residue 101 may have an asphaltene content of more than or equal to 1 wt. %, or more than or equal to 2 wt. %. In some embodiments, the residue 101 may have an asphaltene content of from 2 wt. % to 50 wt. %, from 2 wt. % to 30 wt. %, from 2 wt. % to 20 wt. %, from 2 wt. % to 10 wt. %, from 5 wt. % to 50 wt. %, from 5 wt. % to 30 wt. %, from 5 wt. % to 20 wt. %, or from 5 wt. % to 10 wt. %. The asphaltene content may be measured by n-heptane insoluble fraction (ASTM D 6560 or IP 143).

The residue 101 may contain heavy metals such as vanadium, nickel, iron, or combinations thereof. In some embodiments, the residue 101 may have a total metal content of more than or equal to 20 parts per million by weight (ppmw), or more than or equal to 30 ppmw. In some embodiments, the residue 101 may have a total metal content of from 20 ppmw to 500 ppmw, from 20 ppmw to 400 ppmw, from 20 ppmw to 300 ppmw, from 20 ppmw to 200 ppmw, from 30 ppmw to 500 ppmw, from 30 ppmw to 400 ppmw, from 30 ppmw to 300 ppmw, or from 30 ppmw to 200 ppmw.

SDA Unit—Asphaltene Separator and Resin Separator

Still referring to FIGS. 1-2, as stated previously, the residue 101 may be introduced to the SDA unit 100 and separated into asphaltene pitch 112 and the DAO stream 121 and the resin stream 122.

The SDA unit 100 may include the asphaltene separator 110 which may separate the residue 101 into asphaltene pitch 112 and a stream 111 comprising DAO and resin (remaining residue). The asphaltene separator 110 may reduce asphaltene content of residue 101 from 30 wt. % to less than or equal to 0.1 wt. %, or even less than or equal to 0.01 wt. %. The remaining residue 111 (stream comprising DAO and resin) may have less than 0.1 wt. % or even less than 0.01 wt. % asphaltene compounds. The asphaltene pitch 112 may include at least 70%, at least 80%, at least 90%, or at least 95% of the asphaltene compounds from the residue 101.

Without intent to be bound by any particular theory, asphaltene may create processing problems, as it can precipitate in crude oil production pipelines, inhibiting pipeline flow. Additionally, asphaltene can also be easily converted to coke if subjected to high temperatures, which may be undesirable and problematic. Asphaltene is often used synonymously with pitch and bitumen; however, while pitch and bitumen contain asphaltene, they may additionally contain other fraction contaminants (such as maltene, a non-asphaltene fraction).

Asphaltene typically includes aromatic cores attached to aliphatic carbon side chains. Without intent to be bound by any particular theory, the increased aromaticity of asphaltene may cause interaction with other aromatic compounds, including multi-ringed compounds. Aromatic bonds exhibit greater bond energy than aliphatic carbon-carbon bonds, and thus are harder to break. While use of supercritical water helps to suppress intermolecular reactions through caging effects, the aromatic moieties may be non-reactive at the reaction temperature. Therefore, the side chains present in asphaltene may break away from the aromatic cores while the aromatic moieties remain intact. The aromatic moieties may begin to stack, forming multi-layered aromatic sheets, which may be converted to coke. As mentioned, coke is undesirable and may inhibit pipeline flow or create other processing concerns.

Still referring to FIGS. 1-2, the asphaltene separator 110 may operate at a temperature of from 10° C. to 315° C., from 10° C. to 300° C., from 10° C. to 250° C., from 10° C. to 200° C., from 30° C. to 315° C., from 30° C. to 300° C., from 30° C. to 250° C., or from 30° C. to 200° C.

In some embodiments, the asphaltene separator 110 may operate at a pressure of from 0.05 MPa to 10 MPa, from 0.05 MPa to 8 MPa, from 0.05 MPa to 5 MPa, from 0.1 MPa to 10 MPa, from 0.1 MPa to 8 MPa, from 0.1 MPa to 5 MPa, from 0.5 MPa to 10 MPa, from 0.5 MPa to 8 MPa, from 0.5 MPa to 5 MPa, from 1 MPa to 10 MPa, from 1 MPa to 8 MPa, or from 1 MPa to 5 MPa.

The asphaltene separator 110 may include solvents. The asphaltene pitch 112 may be separated from the residue 101 by contact with solvents. Various solvents are contemplated for the asphaltene separator 110. In one or more embodiments, the solvent may be selected from propane, butanes, pentanes, or combinations thereof. In some embodiments, the solvent to the residue 101 volumetric ratio may be from 2:1 to 20:1, from 2:1 to 10:1, from 3:1 to 20:1, or from 3:1 to 10:1. The residence time of residue 101 in the asphaltene separator 110 may be from 10 minutes (mins) to 60 mins, from 10 mins to 50 mins, from 20 mins to 60 mins, or from 20 mins to 50 mins.

In some embodiments, the asphaltene pitch 112 may have mass yield of from 10% to 90%, from 10% to 80%, from 10% to 60%, from 10% to 40%, from 20% to 90%, from 20% to 80%, from 20% to 60%, from 20% to 40%, from 30% to 90%, from 30% to 80%, from 30% to 60%, or from 30% to 40% of residue 101.

In some embodiments, the asphaltene pitch 112 may have an API gravity from −30 to −5, from −30 to −10, from −30 to −5, from −20 to −5, from −20 to −10, or from −20 to −5.

In some embodiments, the asphaltene pitch 112 may have a total metal content of from 50 ppmw to 1,000 ppmw, from 50 ppmw to 500 ppmw, from 50 ppmw to 400 ppmw, from 50 ppmw to 300 ppmw, from 100 ppmw to 1,000 ppmw, from 100 ppmw to 500 ppmw, from 100 ppmw to 400 ppmw, from 100 ppmw to 300 ppmw, from 200 ppmw to 1,000 ppmw, from 200 ppmw to 500 ppmw, from 200 ppmw to 400 ppmw, or from 200 ppmw to 300 ppmw.

As stated previously, stream 111 comprising DAO and resin may be separated from the residue 101 at the asphaltene separator 110. In some embodiments, the stream 111 comprising DAO and resin may have an API gravity from 2 to 23, from 2 to 20, from 2 to 15, from 2 to 13, from 5 to 23, from 5 to 20, from 5 to 15, from 5 to 13, from 8 to 23, from 8 to 20, from 8 to 15, from 8 to 13, from 10 to 23, from 10 to 20, from 10 to 15, or from 10 to 13.

In some embodiments, the stream 111 comprising DAO and resin may have an asphaltene content of from 1% to 30%, from 1% to 20%, from 1% to 10%, from 1% to 5%, from 0.5% to 30%, from 0.5% to 20%, from 0.5% to 10%, from 0.5% to 5%, from 0.1% to 30%, from 0.1% to 20%, from 0.1% to 10%, from 0.1% to 5%, or from 0.1% to 1% of asphaltene content of feed 101.

In some embodiments, the stream 111 comprising DAO and resin may have a total metal content of from 1 wt ppm to 50 wt ppm, from 1 wt ppm to 30 wt ppm, from 1 wt ppm to 20 wt ppm, from 1 wt ppm to 10 wt ppm, from 1 wt ppm to 2 wt ppm, from 0.1 wt ppm to 50 wt ppm, from 0.1 wt ppm to 30 wt ppm, from 0.1 wt ppm to 20 wt ppm, from 0.1 wt ppm to 10 wt ppm, or from 0.1 wt ppm to 2 wt ppm.

In some embodiments, the stream 111 comprising DAO and resin may have a Conradson Carbon Residue (CCR) content from 1 to 20 wt. %, from 1 to 10 wt. %, from 1 to 5 wt. %, from 0.1 to 20 wt. %, from 0.1 to 10 wt. %, or from 0.1 to 5 wt. %. A CCR may refer to a number from a lab test, which is measured by ASTM D189, indicating a tendency of coke formation.

As stated previously, the SDA unit 100 may further include the resin separator 120 which may separate the stream 111 comprising DAO and resin into the DAO stream 121 and resin stream 122. The resin separator 120 may be disposed downstream of the asphaltene separator 110. The resin separator 120 may be in fluid communication with the asphaltene separator 110 to pass the stream 111 comprising DAO and resin. The stream 111 comprising DAO and resin may be passed directly from the asphaltene separator 110 to the resin separator 120.

In some embodiments, the resin separator 120 may operate at a temperature of from 10° C. to 315° C., from 10° C. to 300° C., from 10° C. to 250° C., from 10° C. to 200° C., from 30° C. to 315° C., from 30° C. to 300° C., from 30° C. to 250° C., or from 30° C. to 200° C.

In some embodiments, the resin separator 120 may operate at a pressure of from 0.05 MPa to 10 MPa, from 0.05 MPa to 8 MPa, from 0.05 MPa to 5 MPa, from 0.1 MPa to 10 MPa, from 0.1 MPa to 8 MPa, from 0.1 MPa to 5 MPa, from 0.5 MPa to 10 MPa, from 0.5 MPa to 8 MPa, from 0.5 MPa to 5 MPa, from 1 MPa to 10 MPa, from 1 MPa to 8 MPa, or from 1 MPa to 5 MPa.

The resin separator 120 may include solvents. Various solvents are contemplated for the resin separator 120. In one or more embodiments, the solvent may be selected from the solvent used for asphaltene separator. In one or more embodiments, the solvent may be selected from propane, butanes, pentanes, or combinations thereof. In some embodiments, the solvent to the stream 111 comprising DAO and resin volumetric ratio may be from 2:1 to 20:1, from 2:1 to 10:1, from 3:1 to 20:1, or from 3:1 to 10:1. The residence time of stream 111 comprising DAO and resin in the resin separator 120 may be from 10 mins to 60 mins, from 10 mins to 50 mins, from 20 mins to 60 mins, or from 20 mins to 50 mins.

As stated previously, the resin separator 120 may be operable to separate the DAO stream 121 and the resin stream 122 from the stream 111 comprising DAO and resin. In some embodiments, the DAO stream 121 may have mass yield of from 10% to 50%, from 10% to 45%, from 10% to 40%, from 20% to 50%, from 20% to 45%, from 20% to 40%, from 30% to 50%, from 30% to 45%, or from 30% to 40% of residue 101.

In some embodiments, the DAO stream 121 may have an API gravity of from 10 to 30, from 10 to 25, from 15 to 30, or from 15 to 25.

In some embodiments, the DAO stream 121 may have an asphaltene content of less than or equal to 7 wt. %, less than or equal to 6 wt. %, or less than or equal to 5 wt. %. The DAO stream 121 may have an asphaltene content of from 0.01 wt. % to 7 wt. %, from 0.01 wt. % to 6 wt. %, from 0.01 wt. % to 5 wt. %, from 0.1 wt. % to 7 wt. %, from 0.1 wt. % to 6 wt. %, or from 0.1 wt. % to 5 wt. %.

In some embodiments, the DAO stream 121 may have a total metal content of less than or equal to 25 ppmw, less than or equal to 20 ppmw, or less than or equal to 15 ppmw. The DAO stream 121 may have a total metal content of from 0.1 ppmw to 25 ppmw, from 0.1 ppmw to 20 ppmw, from 0.1 ppmw to 15 ppmw, from 0.1 ppmw to 10 ppmw, from 1 ppmw to 25 ppmw, from 1 ppmw to 20 ppmw, from 1 ppmw to 15 ppmw, or from 1 ppmw to 10 ppmw.

In some embodiments, the DAO stream 121 may have a CCR content of less than or equal to 15 wt. %, less than or equal to 10 wt. %, or less than or equal to 7 wt. %. The DAO stream 121 may have a CCR content of from 0.1 wt. % to 15 wt. %, from 0.1 wt. % to 10 wt. %, from 0.1 wt. % to 7 wt. %, from 1 wt. % to 15 wt. %, from 1 wt. % to 10 wt. %, or from 1 wt. % to 7 wt. %.

In some embodiments, the DAO stream 121 may have a TBP in which 30% of the fraction evaporates at temperatures of less than or equal to 1200° F., less than or equal to 1100° F., or less than or equal to 1050° F. A TBP may be measured by ASTM D2892 or ASTM D 5236.

Still referring to FIGS. 1 and 2, the resin stream 122 may be separated and obtained from the resin separator 120. The resin stream 122 may be denser or heavier than the DAO stream 121, but lighter than the asphaltene pitch 112. The resin stream 122 may include more aromatic hydrocarbons with highly aliphatic substituted side chains, and also include metals, such as nickel and vanadium. The resin stream 112 may include the material from which the asphaltenes pitch 112 and the DAO stream 121 have been removed.

In some embodiments, the resin stream 122 may have mass yield of from 10% to 40%, from 10% to 35%, from 10% to 30%, from 20% to 40%, from 20% to 35%, or from 20% to 30% of residue 101.

In some embodiments, the resin stream 122 may have an API gravity of from 1 to 20, from 1 to 15, from 1 to 10, from 5 to 20, from 5 to 15, or from 5 to 10.

In some embodiments, the resin stream 122 may have an asphaltene content of from 1% to 10%, from 1.5% to 10%, from 2% to 10%, from 1% to 8%, from 1.5% to 8%, or from 2% to 8% of asphaltene content of the residue 101. In one embodiment, the asphaltene content of resin stream 122 may be higher than that of DAO stream 121. In one embodiment, the asphaltene content of resin stream 122 may be lower than that of the asphaltene pitch 112. In some embodiments, the resin stream 122 may have an asphaltene content of from 0.1 wt. % to 5 wt. %, from 0.1 wt. % to 3 wt. %, from 0.1 wt. % to 2 wt. %, from 0.3 wt. % to 5 wt. %, from 0.3 wt. % to 3 wt. %, or from 0.3 wt. % to 2 wt. %.

In some embodiments, the resin stream 122 may have a total metal content of from 10% to 70%, from 10% to 60%, from 20% to 70%, from 20% to 60%, from 30% to 70%, or from 30% to 60% of total metal content of the residue 101. In one embodiment, the total metal content of resin stream 122 may be higher than that of DAO stream 121. In one embodiment, the total metal content of resin stream 122 may be lower than that of the asphaltene pitch 112. In some embodiments, the resin stream 122 may have a total metal content of from 0.1 ppmw to 25 ppmw, from 0.1 ppmw to 20 ppmw, from 1 ppmw to 25 ppmw, or from 1 ppmw to 20 ppmw.

In some embodiments, the resin stream 122 may have a CCR content of from 10% to 120%, from 10% to 100%, from 30% to 120%, from 30% to 100%, from 50% to 120%, from 50% to 100%, from 60% to 120%, or from 60% to 100% of the CCR content of the residue 101. In one embodiment, the CCR content of resin stream 122 may be higher than that of DAO stream 121. In one embodiment, the CCR content of resin stream 122 may be lower than that of the asphaltene pitch 112. In some embodiments, the resin stream 122 may have a CCR content of from 0.1 wt. % to 20 wt. %, from 0.1 wt. % to 10 wt. %, from 0.1 wt. % to 8 wt. %, from 0.1 wt. % to 5 wt. %, from 1 wt. % to 7 wt. %, or from 1 wt. % to 5 wt. %.

SCW Unit

Still referring to FIGS. 1 and 2, the system 10 may further include the SCW unit 200. The SCW unit 200 may be disposed downstream of the SDA unit 100. The SCW unit 200 may be operable to treat the resin stream 122 with SCW to produce the upgraded resin stream 201. The SCW unit 200 may be in fluid communication with the resin separator 120 to pass the resin stream 122. The resin stream 122 may be passed directly from the resin separator 120 to the SCW unit 200.

The SCW may be introduced to the SCW unit 200. Prior to introducing the SCW, the water stream may be pressured and heated to produce the SCW. In some embodiments, the water stream may include demineralized water, distillated water, boiler feed water (BFW), and deionized water.

The SCW may have a pressure of greater than or equal to 22.1 MPa, which is approximately the critical pressure of water. In some embodiments, the SCW may have a pressure of from 22.1 megapascals (MPa) to 32 MPa, from 22.9 MPa to 31.1 MPa, from 23 MPa to 30 MPa, from 24 MPa to 28 MPa, from 25 MPa to 29 MPa, from 26 MPa to 28 MPa, from 25 MPa to 30 MPa, from 26 MPa to 29 MPa, or from 23 MPa to 28 MPa.

The SCW may have a temperature of greater than or equal to 374° C., which is approximately the critical temperature of water. In some embodiments, the SCW may have a temperature of from 374° C. to 600° C., from 400° C. to 550° C., from 400° C. to 500° C., from 400° C. to 450° C., from 450° C. to 500° C.

As stated previously, the resin stream 122 may be introduced to the SCW unit 200. In some embodiments, prior to introducing the resin stream 122 to the SCW unit 200, the resin stream 122 may be combined with the SCW. In one or more embodiments the weight ratio of the SCW to the resin stream 122 may be from 20:1 to 0.1:1, from 20:1 to 1:1, from 20:1 to 5:1, from 10:1 to 0.1:1, from 10:1 to 1:1, or from 10:1 to 5:1.

In some embodiments, prior to introducing the resin stream 122 to the SCW unit 200, the resin stream 122 may be preheated at the temperature of less than or equal to 500° C., less than or equal to 400° C., or less than or equal to 300° C. The resin stream 122 may be preheated at the temperature of from 200° C. to 500° C., from 80° C. to 500° C., from 100° C. to 500° C., from 120° C. to 500° C., from 50° C. to 400° C., from 80° C. to 400° C., from 100° C. to 400° C., from 120° C. to 400° C., from 50° C. to 300° C., from 80° C. to 300° C., from 100° C. to 300° C., or from 120° C. to 300° C.

The SCW unit 200 may include a reactor. The resin stream 122 may be treated with the SCW at the reactor to produce reactor effluent. In some embodiments, the reactor may include an isothermal or non-isothermal reactor. In embodiments, the reactor may include a tubular-type vertical reactor, a tubular-type horizontal reactor, a vessel-type reactor, a tank-type reactor having an internal mixing device, such as an agitator, or a combination of any of these reactors.

In one embodiment, the SCW unit 200 may be operated in the presence of catalysts. In other embodiments, the SCW unit 200 may be operated in the absence of catalysts and externally provided hydrogen gas ($H_2$). $H_2$ gas may be generated through a steam reforming reaction and a water-gas shift reaction, which is then available for the upgrading reactions. Without being bound by any particular theory, $H_2$ gas may be stable and may require use of catalysts to "activate" the $H_2$ in order to be utilized in hydrogenation reactions. However, hydrogen gas generated from the steam reforming and water-gas shift reactions of the present embodiments may produce "active" $H_2$ gas as an intermediate, which may be used in upgrading reactions without requiring the use of external catalysts.

In some embodiments, the reactor may operate at a temperature of greater than the critical temperature of water and a pressure greater than the critical pressure of water. In some embodiments, the reactor may operate at the temperature of from 380° C. to 550° C., from 400° C. to 550° C., from 420° C. to 550° C., from 380° C. to 500° C., from 400° C. to 500° C., from 420° C. to 500° C., from 380° C. to 460° C., from 400° C. to 460° C., or from 420° C. to 460° C.

In some embodiments, the reactor may operate at a pressure of from 23 MPa to 40 MPa, from 25 MPa to 40 MPa, from 23 MPa to 35 MPa, from 25 MPa to 35 MPa, from 23 MPa to 30 MPa, from 25 MPa to 30 MPa, from 23 MPa to 28 MPa, or from 25 MPa to 28 MPa.

In some embodiments, internal fluid including the SCW and the resin stream 122 in the reactor may have more than or equal to 3000 Reynolds number, more than or equal to 4000 Reynolds number, or more than or equal to 5000 Reynolds number, to maintain turbulence and avoid precipitation of hydrocarbons in the reactor.

In some embodiments, residence time of internal fluid in the reactor may be between 0.1 mins to 60 mins, from 0.5 mins to 60 mins, from 1 min to 60 mins, from 0.1 mins to 30 mins, from 0.5 mins to 30 mins, from 1 min to 30 mins, from 0.1 mins to 10 mins, from 0.5 mins to 10 mins, or from 1 min to 10 mins.

In some embodiments, the temperature of fluid in the terminal position of reactor may be higher than that in the entry position of reactor. "Terminal position" and "entry position" of reactor may refer 90 to 100% of whole length of reactor and 0 to 5% of whole length of reactor respectively.

The SCW unit 200 may further include a heat exchanger downstream of the reactor. The reactor effluent may be introduced to the heat exchanger to produce a heat exchanged stream. The reactor effluent may be cooled down in the heat exchanger. In one embodiment, the heat exchanger may include double pipe type heat exchanger.

The SCW unit 200 may further include a pressure let-down device downstream of the heat exchanger. The heat exchanged stream may be introduced to the pressure let-down device to produce a depressurized stream. The pressure let-down device may include a back pressure regulator, pressure control valve, or both.

The SCW unit 200 may further include a separator downstream of the pressure let-down device. The depressurized stream may be introduced to the separator and separated into the upgraded resin stream 201 and the residual product 202. In embodiments, the separator may be selected from vacuum distillation unit, flash column, solvent separator, or combinations thereof. When the separator includes flash column and vacuum distillation unit, the flash column may separate the depressurized stream into distillates and atmospheric residue fractions. The residue fraction from the flash column may be introduced to the vacuum distillation unit and separated into the upgraded resin stream 201 and the residual product 202.

In some embodiments, the upgraded resin stream 201 may have mass yield of from 30% to 80%, from 30% to 70%, from 40% to 80%, from 40% to 70%, from 50% to 80%, from 50% to 70%, from 60% to 80%, or from 60% to 70% of the resin stream 122.

In some embodiments, the upgraded resin stream 201 may have an API gravity of from 10 to 30, from 10 to 25, from 10 to 20, from 15 to 30, from 15 to 25, or from 15 to 20.

The upgraded resin stream 201 may have the qualities, such as, an asphaltene content, total metal content, and CCR content, comparable with those of the DAO stream 121. In some embodiments, the upgraded resin stream 201 may have an asphaltene content of less than or equal to 10 wt. %, less than or equal to 8 wt. %, or less than or equal to 7 wt. %. The upgraded resin stream 201 may have an asphaltene content of from 0.01 wt. % to 10 wt. %, from 0.01 wt. % to 8 wt. %, from 0.01 wt. % to 7 wt. %, from 0.1 wt. % to 10 wt. %, from 0.1 wt. % to 8 wt. %, or from 0.1 wt. % to 7 wt. %.

In some embodiments, the upgraded resin stream 201 may have a total metal content of less than or equal to 30 ppmw, less than or equal to 25 ppmw, less than or equal to 15 ppmw, less than or equal to 12 ppmw, or less than or equal to 6 ppmw. The upgraded resin stream 201 may have a total metal content of from 0.01 ppmw to 30 ppmw, from 0.01 ppmw to 25 ppmw, from 0.01 ppmw to 15 ppmw, from 0.01 ppmw to 12 ppmw, from 0.01 ppmw to 6 ppmw, from 0.1 ppmw to 30 ppmw, from 0.1 ppmw to 25 ppmw, from 0.1 ppmw to 15 ppmw, from 0.1 ppmw to 12 ppmw, or from 0.1 ppmw to 6 ppmw.

In some embodiments, the upgraded resin stream 201 may have a CCR content of less than or equal to 25 wt. %, less than or equal to 20 wt. %, or less than or equal to 15 wt. %. The upgraded resin stream 201 may have a CCR content of from 0.01 wt. % to 25 wt. %, from 0.01 wt. % to 20 wt. %, from 0.01 wt. % to 15 wt. %, from 0.1 wt. % to 25 wt. %, from 0.1 wt. % to 20 wt. %, or from 0.1 wt. % to 15 wt. %.

In some embodiments, the upgraded resin stream 201 may have a TBP in which 30% of the fraction evaporates at temperatures of less than or equal to 1200° F., less than or equal to 1100° F., or less than or equal to 1050° F. A TBP may be measured by ASTM D2892 or ASTM D5236.

Still referring to FIGS. 1 and 2, the upgraded resin stream 201 may be passed out of the SCW unit 200. The upgraded resin stream 201 may be mixed with the DAO stream 121. Referring to FIG. 2, a portion of the upgraded resin stream 203, 204 may be recycled. In some embodiments, a portion of the upgraded resin stream 203 may be recycled to the asphaltene separator 110. The portion of the upgraded resin stream 203 may be combined with the residue 101 upstream of the asphaltene separator 110. In some embodiments, when the quality of the upgraded resin, such as a total metal content or CCR content, are worse than those of the DAO stream 121, the upgraded resin stream 203 may be recycled to the asphaltene separator 110. In some embodiments, a portion of the upgraded resin stream 204 may be recycled by combining the upgraded resin stream 204 with the remaining residue 111 upstream of the resin separator 120. In some embodiments, when the quality of the upgraded resin stream 203 exceeds that of the DAO stream 121, the upgraded resin stream 203 may be recycled to the resin separator 120.

Referring back to FIGS. 1 and 2, the residual product 202 may be separated from the resin separator 200. The residual product 202 may be passed out of the system 10.

In some embodiments, the residual product 202 may have mass yield of from 10% to 60%, from 10% to 50%, from 10% to 40%, from 20% to 60%, from 20% to 50%, from 20% to 40%, from 30% to 60%, from 30% to 50%, or from 30% to 40% of the resin stream 122.

In some embodiments, the residual product 202 may have an API gravity of from 1 to 15, from 1 to 10, from 5 to 15, or from 5 to 10.

In some embodiments, the residual product 202 may have an asphaltene content of less than or equal to 5 wt. %, less than or equal to 4 wt. %, or less than or equal to 3 wt. %. The residual product 202 may have an asphaltene content of from 0.1 wt. % to 5 wt. %, from 0.1 wt. % to 4 wt. %, from 0.1 wt. % to 3 wt. %, from 1 wt. % to 5 wt. %, from 1 wt. % to 4 wt. %, or from 1 wt. % to 3 wt. %.

In some embodiments, the residual product 202 may have a total metal content of less than or equal to 35 ppmw, less than or equal to 30 ppmw, or less than or equal to 25 ppmw. The residual product 202 may have a total metal content of from 10 ppmw to 35 ppmw, from 10 ppmw to 30 ppmw, from 10 ppmw to 25 ppmw, from 20 ppmw to 35 ppmw, from 20 ppmw to 30 ppmw, from 20 ppmw to 25 ppmw.

In some embodiments, the residual product 202 may have a CCR content of less than or equal to 35 wt. %, less than or equal to 30 wt. %, or less than or equal to 25 wt. %. The residual product 302 may have a CCR content of from 0.1 wt. % to 35 wt. %, from 0.1 wt. % to 30 wt. %, from 0.1 wt. % to 25 wt. %, from 1 wt. % to 35 wt. %, from 1 wt. % to 30 wt. %, or from 1 wt. % to 25 wt. %.

Hydroprocessing Unit

As stated previously, the system 10 may further include the hydroprocessing unit 300 downstream of the SCW unit 200. The hydroprocessing unit 300 may be operable to hydroprocess a portion of the upgraded resin stream 201 and the DAO stream 121 to produce the upgraded product 301 that includes naphtha, gas oil, vacuum gas oil or combinations thereof.

The hydroprocessing unit 300 may be in fluid communication with SCW unit 200 to pass the upgraded resin stream 201. The upgraded resin stream 201 may be passed directly from the hydroprocessing unit 300 to the SCW unit 200. In some embodiments, prior to introducing the upgraded resin stream 201 to the hydroprocessing unit 300, the upgraded resin stream 201 may be combined with the DAO stream 121 to product the mixture.

In some embodiments, the mixture of upgraded resin stream 201 and the DAO stream 121 may have a water content of less than 0.3 wt. %, less than 0.2 wt. %, or about 0.1 wt. %. In some embodiments, each of upgraded resin stream 201 and the DAO stream 121 may have a water content of less than 0.3 wt. %, less than 0.2 wt. %, or 0.1 wt. %.

In some embodiments, the mixture of upgraded resin stream 201 and the DAO stream 121 may have an API gravity of from 10 to 30, from 10 to 25, from 15 to 30, or from 15 to 25.

In some embodiments, the mixture of upgraded resin stream 201 and the DAO stream 121 may have an asphaltene content of from 0.1 wt. % to 10 wt. %, from 0.01 wt. % to 8 wt. %, from 0.01 wt. % to 5 wt. %, from 0.1 wt. % to 10 wt. %, from 0.1 wt. % to 8 wt. %, or from 0.1 wt. % to 5 wt. %.

In some embodiments, the mixture of upgraded resin stream 201 and the DAO stream 121 may have a total metal content of from 0.01 ppmw to 30 ppmw, from 0.01 ppmw to 25 ppmw, from 0.01 ppmw to 15 ppmw, from 0.01 ppmw to 12 ppmw, from 0.01 ppmw to 6 ppmw, from 0.1 ppmw to 30 ppmw, from 0.1 ppmw to 25 ppmw, from 0.1 ppmw to 15 ppmw, from 0.1 ppmw to 12 ppmw, or from 0.1 ppmw to 6 ppmw.

In some embodiments, the mixture of upgraded resin stream 201 and the DAO stream 121 may have a CCR content of from 0.01 wt. % to 25 wt. %, from 0.01 wt. % to 20 wt. %, from 0.01 wt. % to 15 wt. %, from 0.1 wt. % to 25 wt. %, from 0.1 wt. % to 20 wt. %, or from 0.1 wt. % to 15 wt. %.

The hydroprocessing unit 300 may include single or multiple reactors. In some embodiments, the hydroprocessing unit 300 may include two to three reactors in series.

The hydroprocessing unit 300 may operate under mild hydroprocessing conditions. Under mild hydroprocessing conditions, the hydroprocessing unit 300 may help to remove impurities and increase the hydrogen content of feed hydrocarbons. The hydroprocessing unit 300 may remove a total content of sulfur, nitrogen, and metals of greater than or equal to 90 wt. %, or greater than or equal to 95 wt. % based on the mixture of the DAO stream 121 and the upgraded resin stream 201. The hydroprocessing unit 300 may improve the crackability of the upgraded resin stream 201 and the DAO stream 121. Thus, it is a good feed for fluidized catalytic cracker and steam cracker. Various reactions may occur in the hydroprocessing unit 300, such as hydrodesulfurization, hydrodenitrogenation, hydrodemetallization, hydrocracking, hydroisomerization, or combinations thereof.

In some embodiments, the mild hydroprocessing conditions may include liquid hourly space velocity (LHSV) of whole reactors from 0.1 $hr^{-1}$ to 5 $hr^{-1}$, or from 0.1 $hr^{-1}$ to 3 $hr^{-1}$. The reactor may include a catalyst bed that includes a catalyst. The catalyst may include heterogeneous catalysts, homogeneous catalysts, or both. In one embodiment, the catalyst may include NiMo, CoMo, NiCoMo, or combinations thereof, supported on alumina, zeolite, amorphous silica-alumina, or combinations thereof.

In some embodiments, the mild hydroprocessing conditions may include the catalyst bed temperature from 300° C. to 450° C., from 320° C. to 450° C., from 340° C. to 450° C., from 300° C. to 430° C., from 320° C. to 430° C., from 340° C. to 430° C.

In some embodiments, the hydroprocessing unit 300 may require an external supply of molecular hydrogen. In one or more embodiments, the mild hydroprocessing conditions may include hydrogen partial pressure from 1 MPa to 15 MPa, from 2 MPa to 15 MPa, from 3 MPa to 15 MPa, or from 3.5 MPa to 15 MPa.

In one or more embodiments the weight ratio of hydrogen to the mixture of the upgraded resin stream 201 and the DAO stream 121 may be from 200 $Nm^3$/kl (kilo-liter) to 1500 $Nm^3$/kl, or from 200 $Nm^3$/kl to 1200 $Nm^3$/kl.

As stated previously, the hydroprocessing unit 300 may produce the upgraded product 301. Under mild conditions, the hydroprocessing unit 300 may convert greater than or equal to 25 wt. % of the mixture of the DAO stream 121 and the upgraded resin stream 201 to the upgraded products 301. The upgraded product 301 may include naphtha, gas oil, vacuum gas oil, or combinations thereof. The upgraded product 301 may have less than 1% of metals in the mixture of the DAO stream 121 and the upgraded resin stream 201. The upgraded product 301 may have less than 5% of CCR in the mixture of the DAO stream 121 and the upgraded resin stream 201. Demetallization and de-CCR performance of the hydroprocessing unit 300 may be in the range of 95% to 99%. Desulfurization and denitrogenation performance of the hydroprocessing unit 300 may be in the range of 95% to 99%.

Process of Upgrading of the Residue to Produce Upgraded Product

Further embodiments of the present disclosure are directed to processes that utilize the above referenced system 10. As stated previously, the residue 101 may be upgraded by the SDA unit 100 including the asphaltene separator 110 and resin separator 120, the SCW unit 200, and the hydroprocessing unit 300. Hereinafter, different points between the system 10 of upgrading residue and process of upgrading residue will be mainly described, and thus, non-explained portions will be quoted from the system 10 of upgrading residue which are described above.

Referring to FIGS. 1 and 2, the process may include separating the residue 101 through the SDA unit 100 that includes the asphaltene separator 110 and the resin separator 120. The residue 101 may be introduced to the asphaltene separator 110 and separated into the asphaltene pitch 112 and the stream 111 comprising DAO and resin. The stream 111 comprising DAO and resin may be introduced to the resin separator 120 and separated into the DAO stream 121 and the resin stream 122. The resin stream 122 may be introduced to the SCW unit 200 and treated with the SCW to produce the upgraded resin stream 201. The residual product 202 may be separated from the resin stream 122. The upgraded resin stream 201 may be introduced to the hydroprocessing unit 300. In some embodiments, prior to introducing the upgraded resin stream 201 to the hydroprocessing unit 300, the upgraded resin stream 201 may be mixed with the DAO stream 301. The portion of the upgraded resin stream 201 and DAO stream 121 may be hydroprocessed to produce the upgraded product 301.

Referring to FIG. 2, the process may further include recycling a portion of the upgraded resin stream 203 to the asphaltene separator 110. In some embodiments, prior to introducing the upgraded resin stream 203 to the asphaltene separator 110, the upgraded resin stream 203 may be combined with the residue 101.

Still referring to FIG. 2, the process may further include recycling a portion of the upgraded resin stream 204 to the resin separator 120. In some embodiments, prior to introducing the upgraded resin stream 204 to the resin separator 120, the upgraded resin stream 204 may be combined with the remaining residue 111.

EXAMPLES

The following examples illustrate one or more additional features of the present disclosure. It should be understood that these examples are not intended to limit the scope of the disclosure or the appended claims in any manner.

Inventive Example 1

Experimental simulations of embodiments having the configuration and characteristics of the system illustrated in FIG. 1 were performed using the process simulator ASPEN-HYSYS. Table 2 includes data regarding the vacuum residue which is fed to the asphaltene separator.

TABLE 2

| Vacuum Residue | | |
|---|---|---|
| Volumetric Flow Rate | 20000.0 | Barrels per day |
| Mass Flow Rate | 3287.9 | Metric ton per day |
| API Gravity | 5.26 | ° API |
| Density at 15° C. | 1.03 | g/mL |
| Sulfur | 4.26 | wt. % |
| Metals | 97.1 | ppmw |
| CCR | 24 | wt. % |
| $C_7$-Asphaltene | 15.6 | wt. % |

Metal content can't be measured down to 0.01 wt ppm (ppmw).

The vacuum residue was fed to the asphaltene separator. The asphaltene separator employed n-butane as a solvent. The asphaltene separator was operated at solvent/oil ratio of 8/1 vol/vol, 50° C., and 2.9 MPa to produce about 60% mass yield of stream containing DAO and resin to reduce sulfur and metal contents and separate 40% mass yield of asphaltene pitch based on the vacuum residue. Table 3 includes stream properties and compositions for asphaltene pitch. The stream containing DAO and resin was then fed to the resin separator. The resin separator employs n-butane as a solvent. Most of the solvent in the asphaltene separator was going with the stream 111 and it was used for the resin separator. Solvent included in the asphaltene pitch was stripped by steam. The resin separator was operated at 40° C. and 2.0 MPa to produce 35% of mass yield DAO stream and 25% of mass yield resin stream based on the vacuum residue. Tables 4 and 5, as follows, include stream properties and compositions for DAO stream and resin stream respectively.

TABLE 3

| Asphaltene pitch | | |
|---|---|---|
| Volumetric Flow Rate | 7060.4 | Barrels per day |
| Mass Flow Rate | 1315.1 | Metric ton per day |
| API Gravity | −10.6 | ° API |
| Density at 15° C. | 1.17 | g/mL |
| Sulfur | 6.40 | wt. % |
| Metals | 227.1 | wt. % |
| CCR | — | — |
| $C_7$-Asphaltene | — | — |

TABLE 4

| DAO stream | | |
|---|---|---|
| Volumetric Flow Rate | 7812.6 | Barrels per day |
| Mass Flow Rate | 1150.7 | Metric ton per day |
| API Gravity | 21.1 | ° API |
| Density at 15° C. | 0.93 | g/mL |
| Sulfur | 2.19 | wt. % |
| Metals | 2.0 | ppmw |
| CCR | 1.4 | wt. % |
| $C_7$-Asphaltene | 0.4 | wt. % |

TABLE 5

| Resin stream | | |
|---|---|---|
| Volumetric Flow Rate | 5127.0 | Barrels per day |
| Mass Flow Rate | 822.0 | Metric ton per day |
| API Gravity | 8.7 | ° API |
| Density at 15° C. | 1.01 | g/mL |
| Sulfur | 3.80 | wt. % |

TABLE 5-continued

| Resin stream | | |
|---|---|---|
| Metals | 19.6 | ppmw |
| CCR | 3.3 | wt. % |
| $C_7$-Asphaltene | 1.5 | wt. % |

The resin stream and the water stream were fed to the SCW unit that included a gas-fired heater, mixing device, mixture heater, reactor, heat exchanger, pressure let-down device, flash column, and vacuum distillation unit, through separated plunger type pumps. The water stream was pumped to 27 MPa at a flow rate of 1027.5 Metric tons per day (MTD) and then pre-heated to 520° C. by a gas-fired heater. The resin stream was pumped to 27 MPa at a flow rate of 822 MTD and then pre-heated to 230° C. by a gas-fired heater. The feeding weight ratio of water to the resin stream was 1.25:1. The preheated water stream and preheated resin stream were mixed by a mixing device and then injected to a mixture preheater which was consisted of Austenitic stainless steel helical tube having 3.35 inch inside diameter (ID) and 25 meter length. The temperature of the mixed stream in the exit of the mixture preheater was 452° C. The preheated mixed stream was then fed to the reactor to produce the reactor effluent. The reactor was consisted of seven Austenitic stainless steel pipes in series, which has 20.7 inch ID and 10 meter length. The reactor was surrounded by a brick-type insulator to keep the temperature drop within 5° C. The residence time of preheated mixed stream in the reactor is around 150 seconds.

The reactor effluent was then fed to the heat exchanger (double pipe type heat exchanger) and cooled down to produce the heat-exchanged stream having a temperature of around 250° C. The heat-exchanged stream was then subjected to pressure let-down device (two-stage pressure control valve) to the produce depressurized stream having the pressure of 0.9 MPa. The depressurized stream was subjected to a flash column and separated into distillates and atmospheric residue fractions. The atmospheric residue fraction was subjected to the vacuum distillation unit after water was removed by oil-water separator and separated into the residual product and upgraded resin stream. Tables 6 and 7, as follows, include stream properties and compositions for residual product and upgraded resin stream respectively.

TABLE 6

| Residual product | | |
|---|---|---|
| Volumetric Flow Rate | 1917.4 | Barrels per day |
| Mass Flow Rate | 311.3 | Metric ton per day |
| API Gravity | 6.9 | ° API |
| Density at 15° C. | 1.02 | g/mL |
| Sulfur | 3.01 | wt. % |
| Metals | 21.4 | ppmw |
| CCR | 3 | wt. % |
| $C_7$-Asphaltene | 1.4 | wt. % |

TABLE 7

| Upgraded resin stream | | |
|---|---|---|
| Volumetric Flow Rate | 3248.9 | Barrels per day |
| Mass Flow Rate | 486.9 | Metric ton per day |
| API Gravity | 18.5 | ° API |
| Density at 15° C. | 0.94 | g/mL |
| Sulfur | 1.98 | wt. % |
| Metals | 1.0 | ppmw |

TABLE 7-continued

| Upgraded resin stream | | |
|---|---|---|
| CCR | 0.9 | wt. % |
| $C_7$-Asphaltene | 0.4 | wt. % |

The liquid yield of upgraded resin stream at the SCW unit was around 97.1 wt. % based on the resin stream. 2.9 wt. % of resin stream was lost to gas and water (dissolved in water). The upgraded resin stream was mixed with the DAO stream and then introduced to the hydroprocessing unit. Tables 8, as follows, include stream properties and compositions for the mixture of the upgraded resin stream and the DAO stream.

TABLE 8

| Mixture of the upgraded resin stream and the DAO stream | | |
|---|---|---|
| Volumetric Flow Rate | 11061.5 | Barrels per day |
| Mass Flow Rate | 1637.6 | Metric ton per day |
| API Gravity | 20.3 | ° API |
| Density at 15° C. | 0.93 | g/mL |
| Sulfur | 2.13 | wt. % |
| Metals | 1.7 | ppmw |
| CCR | 1.2 | wt. % |
| $C_7$-Asphaltene | 0.41 | wt. % |

The mixture of the upgraded resin stream and the DAO stream was introduced into the hydroprocessing unit and fractioned into four fractions, naphtha, gas oil, vacuum gas oil (VGO), and vacuum residue (VR). The hydroprocessing unit was operated at mild conditions (380° C., 11 MPa, LHSV 0.75/hr, Hz/Oil=800 $nm^3/m^3$). Table 9 includes stream properties and compositions for four fractions.

TABLE 9

| | BP(° C.) | wt. % | API | Sulfur (wt ppm) | CCR (wt. %) | Metals (wt ppm) |
|---|---|---|---|---|---|---|
| Naphtha | C5-180 | 2% | 69.2 | 30 | 0 | 0 |
| Gas Oil | 180-350 | 18% | 35.4 | 45 | 0 | 0 |
| VGO | 350-520 | 58% | 17.5 | 2300 | 0 | 0 |
| VR | 520+ | 23% | 8.6 | 12600 | 0.3 | 0.1 |

Comparative Example 2

Experimental simulations of embodiments the configuration and characteristics of the system having the asphaltene separator without the resin separator were performed using the process simulator ASPEN-HYSYS. The vacuum residue listed in Table 2 was fed to the asphaltene separator. The asphaltene separator was operated in the same condition of Inventive Example 1 and separated the vacuum residue into 65% mass yield of asphaltene pitch and 35% mass yield of DAO stream based on the vacuum residue. Tables 10 and 11, as follow, include stream properties and compositions for asphaltene pitch and DAO stream respectively.

TABLE 10

| Asphaltene pitch | | |
|---|---|---|
| Volumetric Flow Rate | 12187.4 | Barrels per day |
| Mass Flow Rate | 2137.1 | Metric ton per day |
| API Gravity | −3.3 | ° API |
| Density at 15° C. | 1.1 | g/mL |
| Sulfur | 5.38 | wt. % |

TABLE 10-continued

| Asphaltene pitch | | |
|---|---|---|
| Metals | 147.3 | ppmw |
| CCR | — | — |
| $C_7$-Asphaltene | — | — |

TABLE 11

| DAO stream | | |
|---|---|---|
| Volumetric Flow Rate | 7812.6 | Barrels per day |
| Mass Flow Rate | 1150.7 | Metric ton per day |
| API Gravity | 21.1 | ° API |
| Density at 15° C. | 0.93 | g/mL |
| Sulfur | 2.19 | wt. % |
| Metals | 2.0 | ppmw |
| CCR | 1.4 | wt. % |
| $C_7$-Asphaltene | 0.4 | wt. % |

Comparison of Inventive Example 1 and Comparative Example 2

Comparing the system and process of Inventive Example 1 to the system and process of Comparative Example 2, the system and process of Example 1, which utilizes the SDA unit including the asphaltene separator and the resin separator, with the SCW unit, enables more efficient residue upgrading. The feed to the hydroprocessing unit (DAO stream in Table 11) has similar properties with the mixture stream in Table 8. However, in Inventive Example 1, 42% more mass flow rate of feed (the upgraded resin stream and DAO stream in Inventive Example 1 vs DAO stream in Comparative Example 2) was available for the hydroprocessing unit at mild conditions. Inventive Example 1 shows the advantage of SCW treatment of resin to have higher production of feed to the hydroprocessing unit and less disposal to asphaltene pitch. Inventive Example 1 allows 55.3% (11,061.5 BPD/20,000 BPD) of vacuum residue to be fed to the hydroprocessing unit. In contrast, Comparative Example 2 allows 39.1% (7,812.6 BPD/20,000 BPD) of feed to the hydroprocessing unit. To make the same throughput without SCW treatment of the resin fraction, the SDA must produce more DAO; however, this DAO would have more impurities. These impurities would shorten hydroprocessing catalyst life time substantially, for example, reducing hydroprocessing catalyst lifetime by at least half.

A first aspect of the present disclosure is directed to a process for producing upgraded product from residue comprising atmospheric residue or vacuum residue upgrading comprising separating the residue through a SDA unit, wherein the SDA unit includes an asphaltene separator that separates the residue into asphaltene pitch and a stream comprising DAO and resin, and a resin separator that subsequently separates the stream comprising DAO and resin into separate DAO and resin streams, treating the resin stream with SCW to produce an upgraded resin stream, and hydroprocessing a portion of the upgraded resin stream and the DAO stream to produce the upgraded product.

A second aspect of the present disclosure may include the first aspect, further comprising mixing the upgraded resin stream and the DAO prior to the hydroprocessing step.

A third aspect of the present disclosure may include either of the first or second aspects, further comprising recycling a portion of the upgraded resin stream to the asphaltene separator, wherein the upgraded resin stream is combined with the residue prior to the separating step.

A fourth aspect of the present disclosure may include any of the first through third aspects, further comprising recycling a portion of the upgraded resin stream by combining the upgraded resin stream with the remaining residue prior to the separating the remaining residue step.

A fifth aspect of the present disclosure may include any of the first through fourth aspects, where the residue has an API gravity of less than or equal to 22.

A sixth aspect of the present disclosure may include any of the first through fifth aspects, where the residue has an asphaltene content of more than or equal to 2 wt. %.

A seventh aspect of the present disclosure may include any of the first through sixth aspects, where the residue has a total metal content of more than or equal to 20 ppmw.

An eighth aspect of the present disclosure may include any of the first through seventh aspects, where the DAO has an asphaltene content of less than or equal to 7 wt. %.

A ninth aspect of the present disclosure may include any of the first through eighth aspects, where the DAO has a total metal content of less than or equal to 25 ppmw.

A tenth aspect of the present disclosure may include any of the first through ninth aspects, where the DAO has a CCR content of less than or equal to 15 wt. %.

An eleventh aspect of the present disclosure may include any of the first through tenth aspects, where the resin stream has an asphaltene content of from 1% to 10% of an asphaltene content of the residue.

A twelfth aspect of the present disclosure may include any of the first through eleventh aspects, where the resin stream has a total metal content of from 10% to 70% of a total metal content of the residue.

A thirteenth aspect of the present disclosure may include any of the first through twelfth aspects, where the resin stream has a CCR content of from 10% to 120% of a CCR content of the residue.

A fourteenth aspect of the present disclosure may include any of the first through thirteenth aspects, where the weight ratio of the SCW to the resin stream is from 10:1 to 0.1:1.

A fifteenth aspect of the present disclosure may include any of the first through fourteenth aspects, where the treating step takes place at temperature of from 380° C. to 500° C.

A sixteenth aspect of the present disclosure may include any of the first through fifteenth aspects, where the hydroprocessing of the upgraded resin stream removes at least a portion of one or more of metals, nitrogen, or sulfur content from the upgraded resin stream.

A seventeenth aspect of the present disclosure may include any of the first through sixteenth aspects, where the upgraded product comprises naphtha, gas oil, vacuum gas oil or combinations thereof.

An eighteenth aspect of the present disclosure is directed to a system for producing upgraded product from residue comprising atmospheric residue or vacuum residue upgrading, the system comprising: a SDA unit operable to separate the residue, wherein the SDA unit includes an asphaltene separator that separates the residue into asphaltene pitch and a stream comprising DAO and resin, and a resin separator that subsequently separates the stream comprising DAO and resin into separate DAO and resin streams; a SCW unit downstream of the SDA unit, the SCW unit operable to treat the resin stream with supercritical water to produce an upgraded resin stream; and a hydroprocessing unit downstream of the SCW unit, the hydroprocessing unit operable to hydroprocess a portion of the upgraded resin stream and the DAO stream to produce the upgraded product.

A nineteenth aspect of the present disclosure may include the eighteenth aspect, where a portion of the upgraded resin stream is recycled to the asphaltene separator, wherein the upgraded resin stream is combined with the residue upstream of the asphaltene separator.

A twentieth aspect of the present disclosure may include either of the eighteenth or nineteenth aspects, where a portion of the upgraded resin stream is recycled by combining the upgraded resin stream with the remaining residue upstream of the resin separator.

It is noted that one or more of the following claims utilize the term "wherein", "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Further, when an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range. When a component is indicated as present in a range starting from 0, such component is an optional component (i.e., it may or may not be present). When present an optional component may be at least 0.1 weight % of the composition or copolymer.

When materials, methods, or machinery are described herein with the term "known to those of skill in the art", "conventional" or a synonymous word or phrase, the term signifies that materials, methods, and machinery that are conventional at the time of filing the present application are encompassed by this description.

It should be understood that any two quantitative values assigned to a property may constitute a range of that property, and all combinations of ranges formed from all stated quantitative values of a given property are contemplated in this disclosure. The subject matter of the present disclosure has been described in detail and by reference to specific embodiments. It should be understood that any detailed description of a component or feature of one or more embodiments does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A process for producing upgraded product from residue comprising atmospheric residue or vacuum residue upgrading, the process comprising:

separating the residue through a Solvent Deasphalting (SDA) unit, wherein the SDA unit includes an asphaltene separator that separates the residue into asphaltene pitch and a stream comprising deasphalted oil (DAO) and resin, and a resin separator that subsequently separates the stream comprising DAO and resin into separate DAO and resin streams;

treating the resin stream with supercritical water (SCW) to produce an upgraded resin stream; and hydroprocessing a portion of the upgraded resin stream and the DAO stream to produce the upgraded product.

2. The process of claim 1, further comprising mixing the upgraded resin stream and the DAO prior to the hydroprocessing step.

3. The process of claim 1, further comprising recycling a portion of the upgraded resin stream to the asphaltene separator, wherein the upgraded resin stream is combined with the residue prior to the separating step.

4. The process of claim 1, further comprising recycling a portion of the upgraded resin stream by combining the upgraded resin stream with the remaining residue prior to the separating the remaining residue step.

5. The process of claim 1, where the residue has an API gravity of less than or equal to 22.

6. The process of claim 1, where the residue has an asphaltene content of more than or equal to 2 weight percent (wt. %).

7. The process of claim 1, where the residue has a total metal content of more than or equal to 20 parts per million by weight (ppmw).

8. The process of claim 1, where the DAO has an asphaltene content of less than or equal to 7 wt. %.

9. The process of claim 1, where the DAO has a total metal content of less than or equal to 25 ppmw.

10. The process of claim 1, where the DAO has a CCR content of less than or equal to 15 wt. %.

11. The process of claim 1, where the resin stream has an asphaltene content of from 1% to 10% of an asphaltene content of the residue.

12. The process of claim 1, where the resin stream has a total metal content of from 10% to 70% of a total metal content of the residue.

13. The process of claim 1, where the resin stream has a CCR content of from 10% to 120% of a CCR content of the residue.

14. The process of claim 1, where the weight ratio of the SCW to the resin stream is from 10:1 to 0.1:1.

15. The process of claim 1, where the treating step takes place at temperature of from 380 Celsius (° C.) to 500° C.

16. The process of claim 1, where the hydroprocessing of the upgraded resin stream removes at least a portion of one or more of metals, nitrogen, or sulfur content from the upgraded resin stream.

17. The process of claim 1, where the upgraded product comprises naphtha, gas oil, vacuum gas oil, or combinations thereof.

* * * * *